US011612281B1

(12) United States Patent
Seifman et al.

(10) Patent No.: US 11,612,281 B1
(45) Date of Patent: Mar. 28, 2023

(54) TOILET STORAGE SYSTEM AND METHOD OF USE

(71) Applicants: Whitney Caroline Seifman, Las Vegas, NV (US); Jacob Thomas Seifman, Las Vegas, NV (US)

(72) Inventors: Whitney Caroline Seifman, Las Vegas, NV (US); Jacob Thomas Seifman, Las Vegas, NV (US)

( * ) Notice: Subject to any disclaimer, the term of this patent is extended or adjusted under 35 U.S.C. 154(b) by 364 days.

(21) Appl. No.: 16/885,897

(22) Filed: May 28, 2020

Related U.S. Application Data

(60) Provisional application No. 62/858,618, filed on Jun. 7, 2019.

(51) Int. Cl.
*A47K 13/24* (2006.01)
*A47K 13/26* (2006.01)

(52) U.S. Cl.
CPC ..... *A47K 13/24* (2013.01); *A47K 13/26* (2013.01)

(58) Field of Classification Search
CPC ..... A47K 13/24
USPC ..... 312/242
See application file for complete search history.

(56) References Cited

U.S. PATENT DOCUMENTS

| | | | | | |
|---|---|---|---|---|---|
| 1,773,684 | A * | 8/1930 | Kolber | A47B 67/005 | 362/128 |
| 1,966,800 | A * | 7/1934 | Katzman | A47B 67/005 | 359/860 |
| 6,382,746 | B1 * | 5/2002 | Rosas | A47B 67/005 | 312/227 |
| 7,174,578 | B1 * | 2/2007 | Mitchell | A47K 17/00 | 4/661 |
| 8,991,947 | B2 * | 3/2015 | Lee | B64D 11/04 | 312/242 |
| 9,013,071 | B1 * | 4/2015 | Levi | A45D 20/14 | 312/351 |
| 2007/0018544 | A1 * | 1/2007 | Bright | A47B 67/02 | 312/242 |
| 2014/0366262 | A1 * | 12/2014 | Flynn | A47K 3/32 | 4/514 |
| 2015/0374121 | A1 * | 12/2015 | Wood | A47B 96/04 | 312/245 |
| 2019/0142231 | A1 * | 5/2019 | Nelson | A47K 11/026 | 4/483 |

* cited by examiner

*Primary Examiner* — Lori L Baker
(74) *Attorney, Agent, or Firm* — Leavitt Eldredge Law Firm

(57) ABSTRACT

A bathroom storage system comprising of a contoured body configured to receive the base of a toilet, to conveniently organize and store items within the bathroom without taking up excess space.

1 Claim, 4 Drawing Sheets

TOILET STORAGE SYSTEM AND METHOD OF USE

BACKGROUND

1. Field of the Invention

The present invention relates generally to storage systems, and more specifically to a bathroom storage system and method of use.

2. Description of Related Art

Storage systems are well known in the art and are effective means to organize living spaces. Commonly in the art, bathroom storage systems use cabinets to store bathroom accessories such as toilet paper, towels, soap, and the like. One of the problems commonly associated with this is that cabinets are generally large and take up valuable space within a bathroom.

Accordingly, although great strides have been made in the area of bathroom storage systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
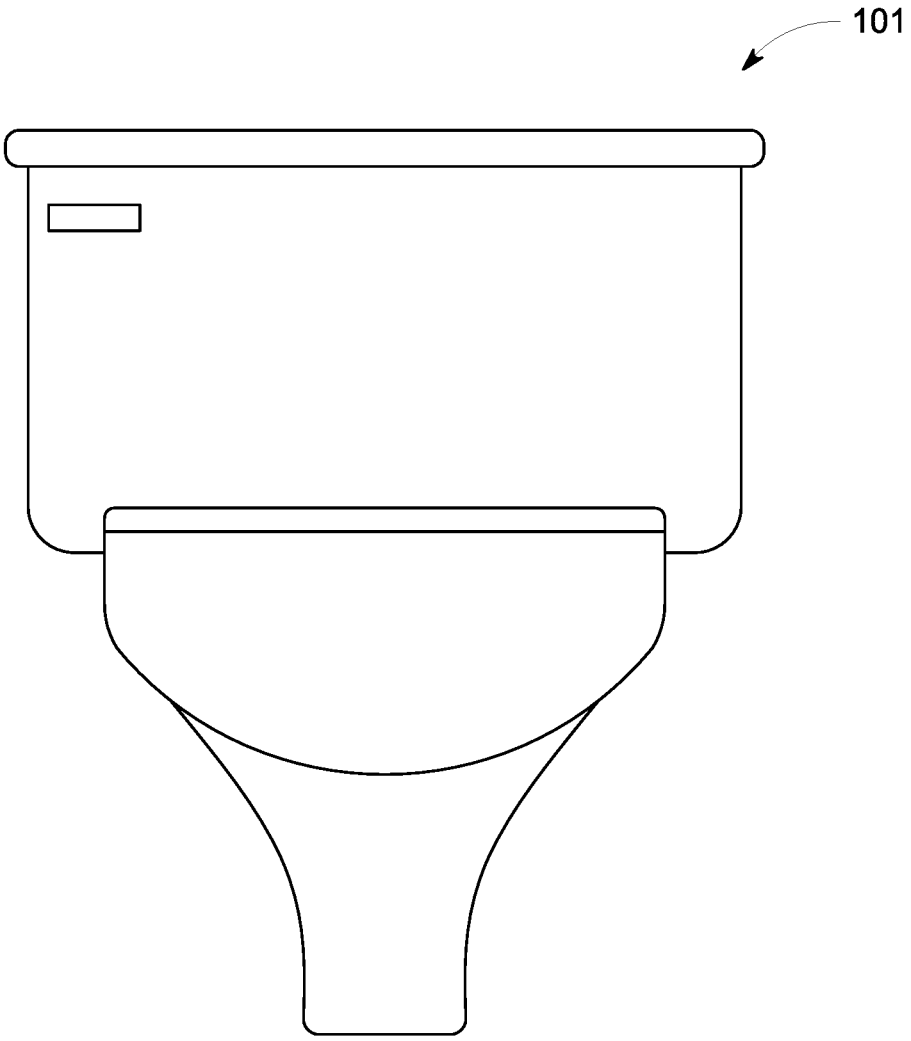
FIG. 1 is a front view of a conventional toilet.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional toilet storage systems. Specifically, the system of the present invention decreases the amount of space taken up in bathrooms. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, the figures depict various embodiments of the system and method of use in accordance with the preferred embodiment of the present invention. It should be understood that the embodiments discussed herein are substantially similar in form and function and share one or more of the features discussed in each embodiment although the features may not be shown specifically with reference to the particular embodiment.

Referring now to FIG. 1, a front view of a conventional toilet 101 is shown without the bathroom storage system 201 secured thereto. In one embodiment, the bathroom storage system 201 is configured to secure to the base of the toilet, as shown in the top view of FIG. 2B.

Figure 2A:
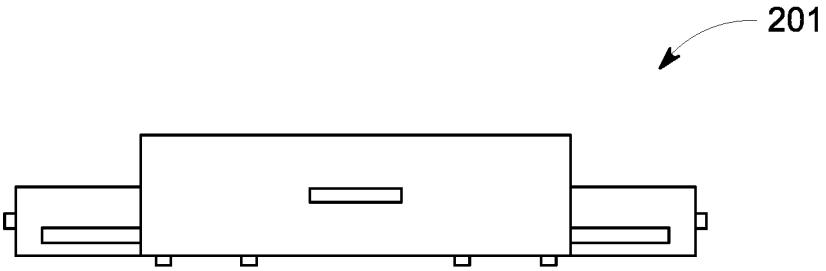
FIG. 2A is a front view of a preferred embodiment of the bathroom storage system of the present application.
Figure 2B:
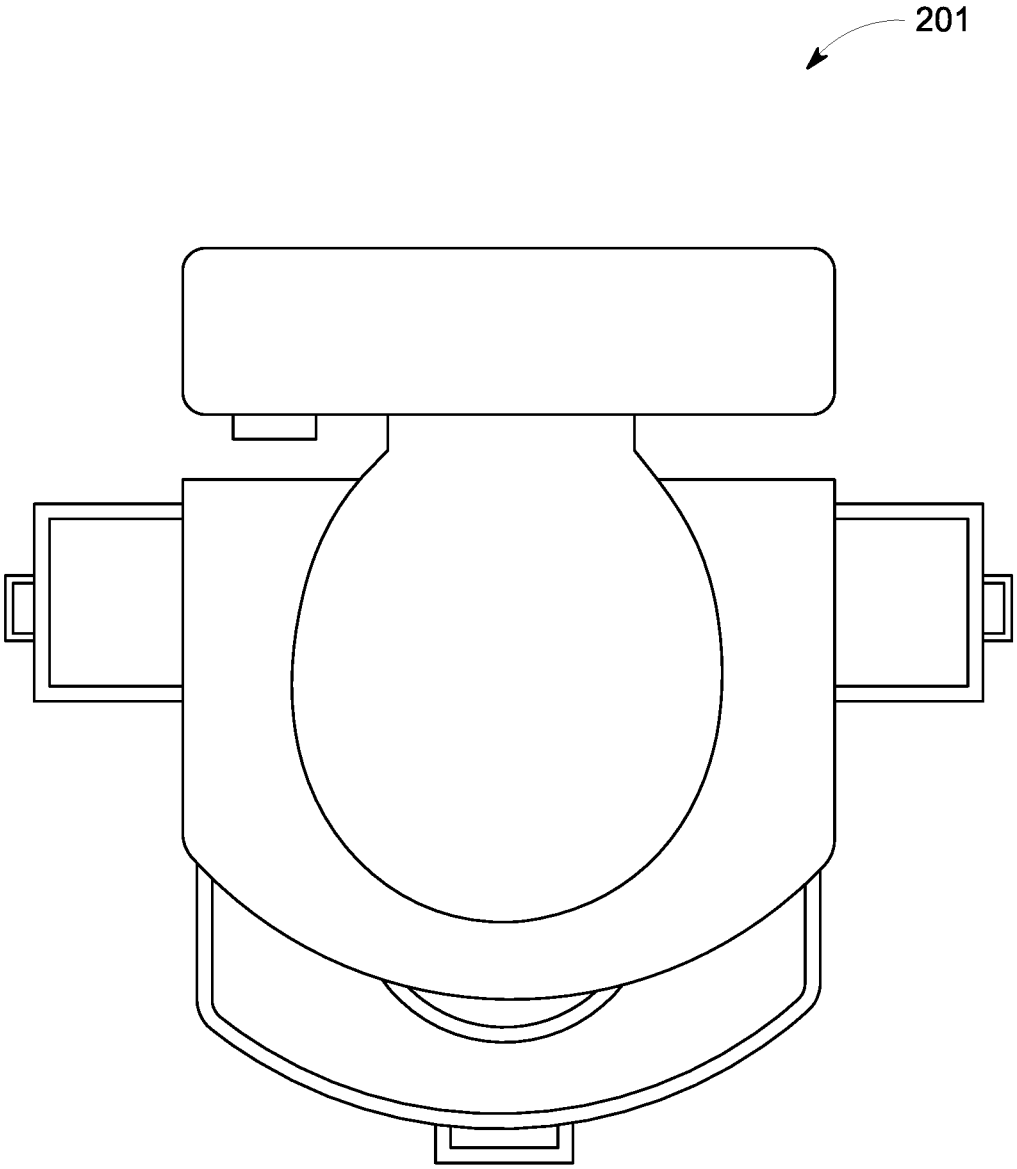
FIG. 2B is a top view of a preferred embodiment of the bathroom storage system of the present application.

In FIG. 2A, a front view of the system 201 is shown. In the embodiment, the storage includes a contoured body configured to match the contouring of the toilet base, as shown in FIG. 2C.

Figure 2C:
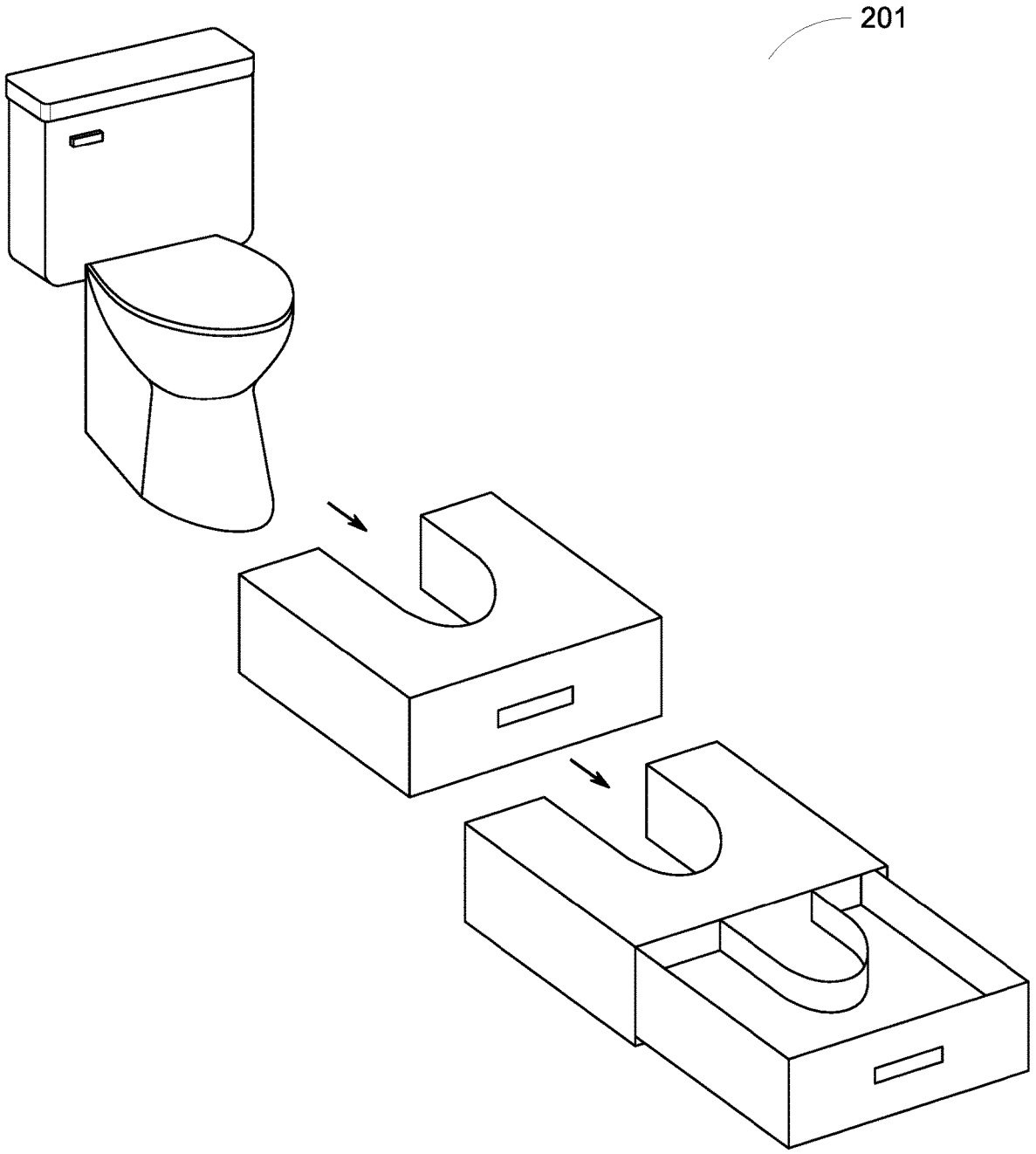
FIG. 2C is an exploded oblique view of a preferred embodiment of the bathroom storage system.

In FIG. 2C, an exploded oblique view of the system 201 is shown. In one embodiment, the contoured shape of the body could merely slide against the base of the toilet without a fastening means. However, it will be appreciated that it is contemplated utilizing different fastening means such as straps, clips, magnets, adhesive, and the like in an alternative embodiment to secure the contoured body to the base of the toilet.

Figure 3A:
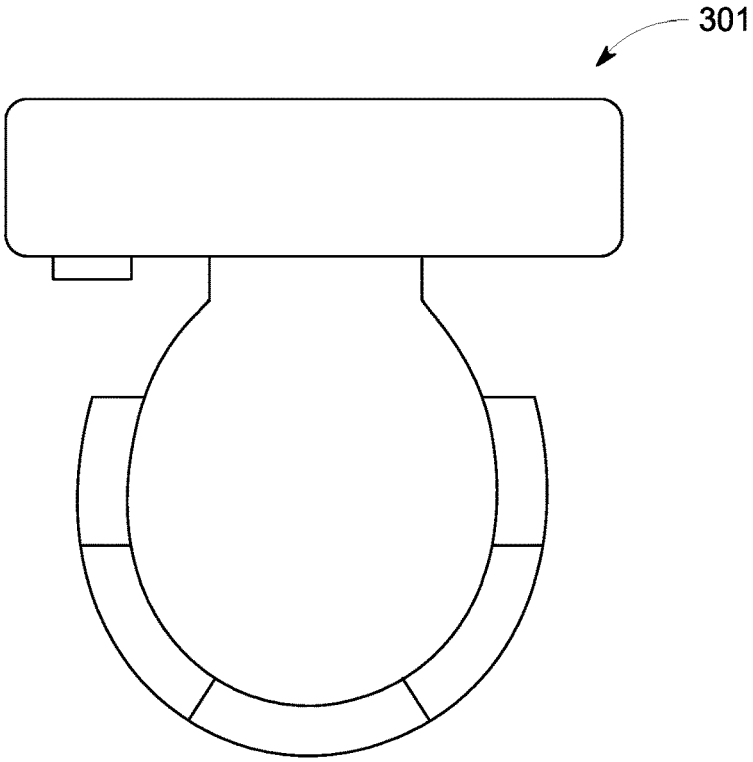
FIG. 3A is a top view of the bathroom storage system having shelves according to one embodiment of the present invention.
Figure 3B:
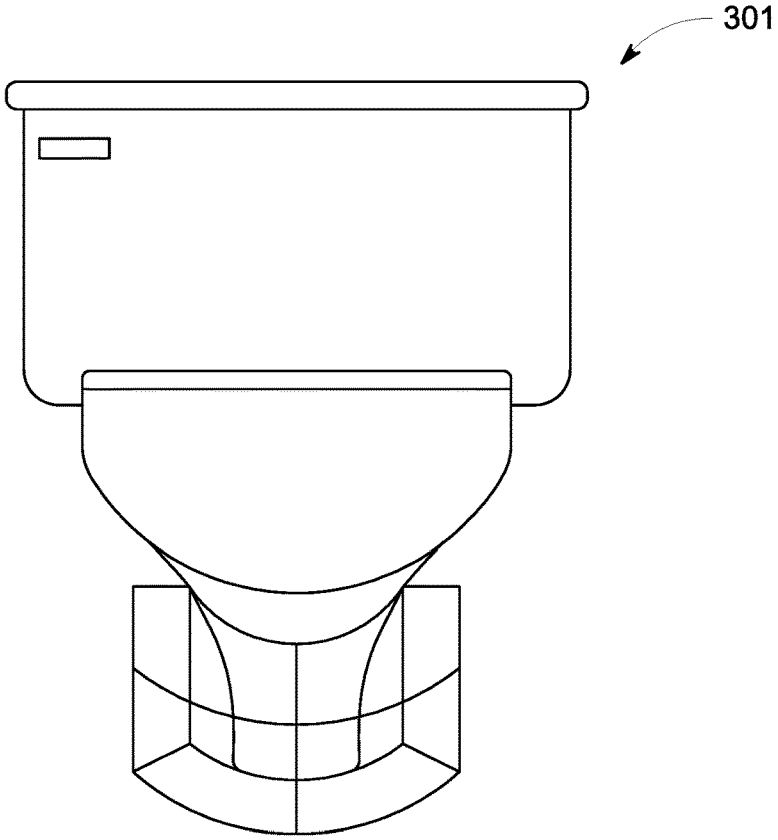
FIG. 3B is a front view of the bathroom storage system having shelves according to one embodiment of the present invention.

In FIGS. 3A and 3B, respective top and front views of the system 301 are shown in accordance with another contemplated embodiment of the present invention. In this embodiment, it is desired to have one or more shelves in lieu of or in addition to the shelves discussed above.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A bathroom storage system, comprising:

a body having a curved shape and configured to fit under a bowl of a toilet seat and around a base of the bowl, the body having:

one or more drawers configured to traverse relative to the base of the bowl; and one or more shelves; and one or more fasteners;

wherein the body is configured to receive the base of the bowl.

* * * * *